US011555384B2

(12) United States Patent
Knight et al.

(10) Patent No.: US 11,555,384 B2
(45) Date of Patent: Jan. 17, 2023

(54) MODULAR PERFORATING GUN SYSTEMS AND METHODS

(71) Applicant: G&H Diversified Manufacturing LP, Houston, TX (US)

(72) Inventors: Benjamin Vascal Knight, Houston, TX (US); James Edward Kash, Houston, TX (US); Ryan Ward, Tomball, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 0 days.

(21) Appl. No.: 17/546,517

(22) Filed: Dec. 9, 2021

(65) Prior Publication Data

US 2022/0098959 A1 Mar. 31, 2022

Related U.S. Application Data

(63) Continuation of application No. 17/118,293, filed on Dec. 10, 2020, now Pat. No. 11,215,041.

(60) Provisional application No. 62/946,385, filed on Dec. 10, 2019.

(51) Int. Cl.

| | |
|---|---|
| ***E21B 43/117*** | (2006.01) |
| ***E21B 43/1185*** | (2006.01) |
| ***E21B 43/116*** | (2006.01) |

(52) U.S. Cl.

CPC ..... *E21B 43/117* (2013.01); *E21B 43/116* (2013.01); *E21B 43/1185* (2013.01)

(58) Field of Classification Search

CPC ... E21B 43/116; E21B 43/117; E21B 43/1185

See application file for complete search history.

(56) References Cited

U.S. PATENT DOCUMENTS

| | | | | |
|---|---|---|---|---|
| 4,598,776 | A * | 7/1986 | Stout | E21B 43/117 175/4.54 |
| 10,485,213 | B1 * | 11/2019 | Owen | A01H 5/10 |
| 2012/0152614 | A1 * | 6/2012 | Rodgers | E21B 43/1195 175/2 |
| 2013/0008639 | A1 * | 1/2013 | Tassaroli | E21B 43/116 166/55.2 |
| 2017/0115102 | A1 * | 4/2017 | Knight | E21B 43/117 |

* cited by examiner

*Primary Examiner* — Yong-Suk (Philip) Ro

(74) *Attorney, Agent, or Firm* — Conley Rose, P.C.

(57) ABSTRACT

A perforating gun includes an outer sleeve included of a generally tubular wall structure having a peripheral surface around the outside, opposite ends thereof and a central passage therethrough extending from one end to the other end and further including a connection at each end to connect to other tools in a tool string wherein the outer sleeve is configured to carry the tensile and compressive forces imposable on the perforating gun as the perforating gun is deployed in the wellbore, and at least one pressure sealed perforating module installed within the central passage of the outer sleeve having a shaped charge sealed therein and wherein the installation of the pressure sealed perforating module within the outer sleeve is configured to substantially eliminate the transfer of tensile or compressive forces imposable on or by the tool string onto the at least one pressure sealed perforating module.

20 Claims, 14 Drawing Sheets

MODULAR PERFORATING GUN SYSTEMS AND METHODS

CROSS-REFERENCE TO RELATED APPLICATIONS

The present application is a continuation of U.S. non-provisional patent application Ser. No. 17/118,293 filed Dec. 10, 2020, entitled "Modular Perforating Gun Systems and Methods," which claims benefit of U.S. provisional patent application No. 62/946,385 filed Dec. 10, 2019, entitled "Modular Perforating Gun System," both of which are incorporated herein by reference in their entirety for all purposes.

STATEMENT REGARDING FEDERALLY SPONSORED RESEARCH OR DEVELOPMENT

Not applicable.

BACKGROUND

During completion operations for a subterranean wellbore, it is conventional practice to perforate the wellbore and any casing pipes disposed therein with a perforating gun at each production zone to provide a path(s) for formation fluids (e.g., hydrocarbons) to flow from a production zone of a subterranean formation into the wellbore. To ensure that each production zone is isolated within the wellbore, plugs, packers, and/or other sealing devices are installed within the wellbore between each production zone prior to perforation activities. In order to save time as well as reduce the overall costs of completion activities, it is often desirable to simultaneously lower both a setting tool and at least one perforating gun along the same tool string within the wellbore in order to set the sealing device as well as perforate the wellbore in a single trip downhole.

SUMMARY

An embodiment of a perforating gun deployable in a wellbore as part of a tool string comprises an outer sleeve comprised of a generally tubular wall structure having a peripheral surface around the outside, opposite ends thereof and a central passage therethrough extending from one end to the other end and further including a connection at each end to connect to other tools in the tool string wherein the outer sleeve is configured to carry the tensile and compressive forces imposable on the perforating gun as the perforating gun is deployed in the wellbore, and at least one pressure sealed perforating module installed within the central passage of the outer sleeve having a shaped charge sealed therein and wherein the installation of the pressure sealed perforating module within the outer sleeve is configured to substantially eliminate the transfer of tensile or compressive forces imposable on or by the tool string onto the at least one pressure sealed perforating module. In some embodiments, the outer sleeve includes at least one radial perforation through the tubular wall structure from the central passage to the peripheral surface that is sized for an explosive jet from a shaped charge to pass through the tubular wall structure and then penetrate through casing inside the wellbore, and wherein the shaped charge of the at least one pressure-sealed perforating module is oriented in substantial alignment with the radial perforation in the tubular wall structure of the outer sleeve. In some embodiments, the at least one pressure sealed perforating module comprises a tubular housing in which the shaped charge is received and having a radial indention formed therein and substantially aligned for the shaped charge to produce an explosive jet therethrough. In certain embodiments, the shaped charge of the at least one pressure-sealed perforating module extends longitudinally in a direction oriented at a non-zero angle relative to a longitudinal axis of the outer sleeve. In certain embodiments, the perforating gun comprises an axis of the perforating gun extending from one end of the outer sleeve to the other end aligned at the center of the central passage, and further wherein the outer sleeve includes a pressure bulkhead at each end of the outer sleeve wherein the bulkheads attach to the tubular wall structure whereby the pressure sealed module is in compression in the axial direction and the tubular wall structure is in tension. In certain embodiments, the perforating gun comprises including a plurality of separate pressure sealed perforating modules installed in the central passage of the outer sleeve, wherein each of the plurality of pressure sealed perforating modules includes an individually addressable electrical switch which allows for the shaped charges in the plurality of pressure sealed perforating modules to be detonated in a sequential and selectable firing of individual pressure sealed perforating modules. In some embodiments, the plurality of pressure sealed perforating modules are each designed to withstand wellbore pressure and shock waves generated by the detonation of explosives within the wellbore. In some embodiments, the at least one pressure sealed perforating module includes an individually addressable electrical switch and its own individual radial perforation in the respective outer sleeve substantially aligned for the shaped charge to produce an explosive jet therethrough wherein an individually addressable switch allows for the shaped charge in a pressure sealed perforating module to be detonated individually in a sequential and selectable firing manner. In certain embodiments, the at least one pressure sealed perforating module comprises a tubular housing having an interior in which the shaped charge is received and which is sealed from the central passage of the outer sleeve. In certain embodiments, the at least one pressure sealed perforating module comprises an individually addressable electrical switch and an electrical connector coupled to the tubular housing and electrically connected to the electrical switch.

An embodiment of a tool string comprising a plurality of perforating guns attached to one another end to end where the perforating guns each comprise an outer sleeve comprised of a generally tubular wall structure having a peripheral surface around the outside, opposite ends thereof and a central passage therethrough extending from one end to the other and further including a connection at each end to connect to other tools in the tool string wherein the outer sleeve is configured to carry the tensile and compressive forces imposable on the perforating gun as the perforating gun is deployed in a wellbore, and a plurality of separate pressure sealed perforating modules installed within the central passage of the outer sleeve, each pressure sealed perforating module having a shaped charge therein and wherein the installation of the pressure sealed perforating module within the outer sleeve is arranged in a manner that substantially eliminates tensile or compressive forces that may be imposed on or by the tool string to be transmitted to or imposed upon any pressure sealed perforating module. In some embodiments, each of the plurality of pressure-sealed perforating modules includes an individually addressable electrical switch which allows for the shaped charges in the plurality of pressure-sealed perforating modules to be detonated in a sequential and selectable firing of individual pressure-sealed perforating modules. In some embodiments, the installation of the plurality of pressure-sealed perforating modules within the outer sleeve is configured to substantially eliminate the transmission of tensile or compressive forces imposable on or by the tool string upon any of the plurality of pressure-sealed perforating modules. In certain embodiments, the outer sleeve of each perforating gun includes a plurality of radial perforations through the wall from the central passage to the peripheral surface sized for an explosive jet from a shaped charge to pass through the wall and then penetrate through casing inside the wellbore, and wherein the shaped charge of each of the plurality of pressure-sealed perforating modules is oriented in substantial alignment with the radial perforation in the wall of the outer sleeve. In certain embodiments, the shaped charge of each of the plurality of pressure-sealed perforating module extends longitudinally in a direction oriented at a non-zero angle relative to a longitudinal axis of the outer sleeve. In some embodiments, each perforating gun includes an axis of the perforating gun extending from one end of the outer sleeve to the other end aligned at the center of the central passage, and further wherein the outer sleeve of each perforating gun includes a pressure bulkhead at each end of the outer sleeve wherein the bulkheads attach to the tubular wall structure whereby each of the plurality of pressure-sealed modules are in compression in the axial direction and the tubular wall structure is in tension. In some embodiments, the plurality of pressure-sealed perforating modules includes at least three pressure-sealed perforating modules installed in the central passage of the outer sleeve where each of the at least three pressure-sealed perforating module includes an individually addressable electrical switch which allows for the shaped charges in the at least three pressure-sealed perforating modules to be detonated in a sequential and selectable firing of individual pressure-sealed perforating modules. In some embodiments, the plurality of pressure-sealed perforating modules are individually and separately sealed from each other. In certain embodiments, each of the plurality of pressure-sealed perforating modules comprises a tubular housing having an interior in which the shaped charge is received and which is sealed from the central passage of the outer sleeve. In certain embodiments, each of the plurality of pressure-sealed perforating modules comprises an electrical connector to electrically connect each of the plurality of pressure-sealed perforating modules together in response to inserting each of the plurality of pressure-sealed perforating modules into the central passage of the outer sleeve.

BRIEF DESCRIPTION OF THE DRAWINGS

For a detailed description of exemplary embodiments of the disclosure, reference will now be made to the accompanying drawings in which.

DETAILED DESCRIPTION

Figure 1:
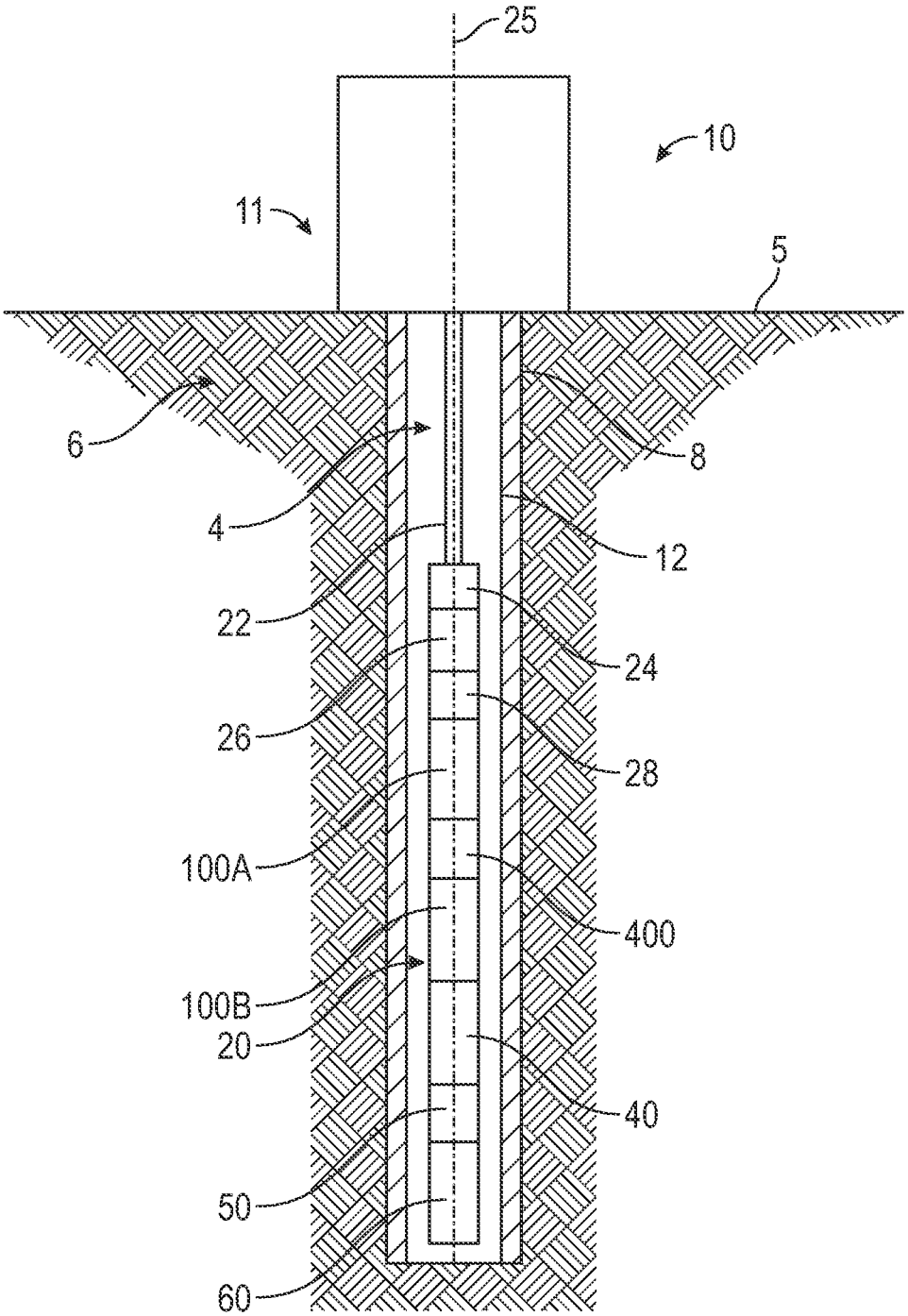
FIG. 1 is a schematic, view of a system for completing a subterranean well including a tool string in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring now to FIG. 1, a system 10 for completing a wellbore 4 extending into a subterranean formation 6 is shown. In the embodiment of FIG. 1, wellbore 4 is a cased wellbore including a casing string 12 secured to an inner surface 8 of the wellbore 4 using cement (not shown). In some embodiments, casing string 12 generally includes a plurality of tubular segments coupled together via a plurality of casing collars. Completion system 10 includes a surface assembly 11 positioned at a surface 5 and a tool string 20 deployable into wellbore 4 from the surface 5 using surface assembly 11. Surface assembly 11 may comprise any suitable surface equipment for drilling, completing, and/or operating well 20 and may include, in some embodiments, derricks, structures, pumps, electrical/mechanical well control components, etc. Tool string 20 of completion system 10 may be suspended within wellbore 4 from a wireline 22 that is extendable from surface assembly 11. Wireline 22 comprises an armored cable and includes at least one electrical conductor for transmitting power and electrical signals between tool string 20 and a control system or firing panel of surface assembly 11 positioned at the surface 5.

In some embodiments, system 10 may further include suitable surface equipment for drilling, completing, and/or operating completion system 10 and may include, for example, derricks, structures, pumps, electrical/mechanical well control components, etc. Tool string 20 is generally configured to perforate casing string 12 to provide for fluid communication between formation 6 and wellbore 4 at predetermined locations to allow for the subsequent hydraulic fracturing of formation 6 at the predetermined locations.

In this embodiment, tool string 20 has a central or longitudinal axis 25 and generally includes a cable head 24, a casing collar locator (CCL) 26, a direct connect sub 28, a first or upper perforating gun or tool 100A, an orientation sub 400, a second or lower perforating gun or tool 1006, a plug-shoot firing head (PSFH) 40, a setting tool 50, and a downhole or frac plug 60. In other embodiments, the configuration of tool string 20 may vary. For instance, in other embodiments, tool string 20 may comprise other components such as a fishing neck, one or more weight bars, one or more safety subs, etc. Cable head 24 is the uppermost component of tool string 20 and includes an electrical connector for providing electrical signal and power communication between the wireline 22 and the other components (CCL 26, perforating gun 100, PSFH 40, setting tool 50, etc.) of tool string 20. CCL 26 is coupled to a lower end of the cable head 24 and is generally configured to transmit an electrical signal to the surface via wireline 22 when CCL 26 passes through a casing collar of casing string 12, where the transmitted signal may be recorded at surface assembly 11 as a collar kick to determine the position of tool string 20 within wellbore 4 by correlating the recorded collar kick with an open hole log. The direct connect sub 28 is coupled to a lower end of CCL 26 and is generally configured to provide a connection between the CCL 26 and the portion of tool string 20 including the perforating gun 100 and associated tools, such as the setting tool 50 and downhole plug 60.

As will be discussed further herein, upper perforating gun 100A of tool string 20 is coupled to direct connect sub 28 and is generally configured to perforate casing string 12 and provide for fluid communication between formation 6 and wellbore 4. As will be discussed further herein, perforating guns 100A, 1006 each include a plurality of shaped charges that may be detonated by one or more signals conveyed by the wireline 22 from the firing panel of surface assembly 11 to produce one or more explosive jets directed against casing string 12. Perforating guns 100A, 1006 may each comprise a wide variety of sizes such as, for example, 2¾", 3⅛", or 3⅜", wherein the above listed size designations correspond to an outer diameter of perforating guns 100A, 100B. In this embodiment, orientation sub 400 is coupled directly between perforating guns 100A, 100B. As will be discussed further herein, orientation sub 400 may define an angular orientation or offset between perforating guns 100A, 100B which may be tailored by an operator of tool string 20 depending upon the particular application. In other embodiments, tool string 20 may include a tandem sub in lieu of the orientation sub 400, the tandem sub configured to couple the perforating guns 100A, 1006 together and comprising an electric feed-thru assembly. In this embodiment, PSFH 40 of tool string 20 is coupled to a lower end of the lower perforating gun 1006. PSFH 40 couples the lower perforating gun 1006 of the tool string 20 to the setting tool 50 and downhole plug 60 and is generally configured to pass a signal from the wireline 22 to the setting tool 50 of tool string 20. In this embodiment, PSFH 40 also includes electrical components to fire the setting tool 50 of tool string 20.

In this embodiment, tool string 20 further includes setting tool 50 and downhole plug 60, where setting tool 50 is coupled to a lower end of PSFH 40 and is generally configured to set or install downhole plug 60 within casing string 12 to fluidically isolate desired segments of the wellbore 4. Once downhole plug 60 has been set by setting tool 50, an outer surface of downhole plug 60 seals against an inner surface of casing string 12 to restrict fluid communication through wellbore 4 across downhole plug 60. Downhole plug 60 of tool string 20 may be any suitable downhole or frac plug known in the art while still complying with the principles disclosed herein.

Figure 2:
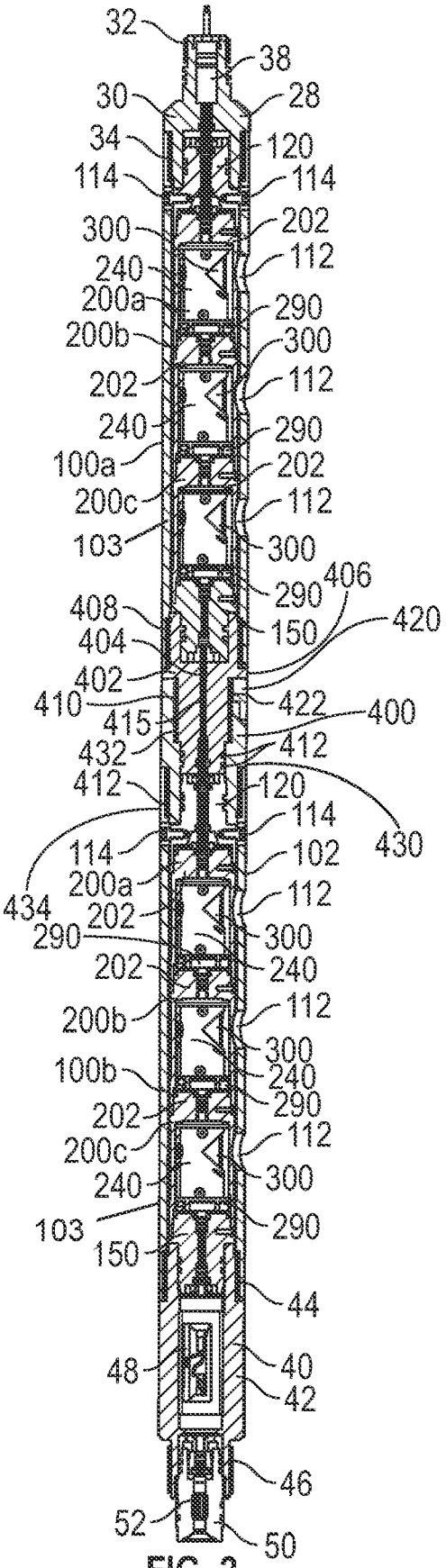
FIG. 2 is a side cross-sectional view of embodiments of a direct connect sub, a pair of perforating guns, an orientation sub, and a plug-shoot firing head of the tool string of FIG. 1 in accordance with principles disclosed herein.

Referring to FIG. 2, embodiments of the upper perforating gun 100A, orientation sub 400, and lower perforating gun 100B of the tool string 20 of FIG. 1 is shown. In some embodiments, perforating guns 100A, 100B are configured similarly and thus discussion of the configuration of upper perforating gun 100A may equally pertain to lower perforating gun 1006 and vice-a-versa. In the embodiment of FIG. 2, upper perforating gun 100A has a central or longitudinal axis 105 which may be coaxial with central axis 25 and generally includes an outer sleeve or housing 102, a first or upper pressure bulkhead 120, a second or lower pressure bulkhead 150, and a plurality of pressure-sealed perforating modules or assemblies 200A-200C each positioned in outer sleeve 102 and oriented in substantial alignment with the ports 112 of outer sleeve 102. Each of perforating modules 200A-200C is configured to withstand wellbore pressure and shock waves generated by the detonation of explosives (e.g., shaped charges) within the wellbore 4. Although perforating modules 200A-200C are labeled differently in FIG. 2, each perforating module 200A-200C is similarly configured. In other words, an upper perforating module 200A is configured the same as central perforating module 200B, and lower perforating module 200C. For context, embodiments of the direct connect sub 28, orientation sub 400, PSFH 40, and a portion of setting tool 50 are also shown in FIG. 2.

In this embodiment, direct connect sub 28 generally includes an outer housing 30 and an electrical connector assembly 38 positioned in housing 30. Outer housing 30 of direct connect sub 28 is generally cylindrical and includes an outer surface having an external first or upper connector 32 positioned at a first or upper end of outer housing 30 and an external second or lower connector 34 positioned at an opposing second or lower end of outer housing 30. In this embodiment, connectors 32, 34 each comprise threaded connectors configured for forming a threaded connection with a corresponding internal connector; however, in other embodiments, each may comprise other forms of connectors configured for forming a releasable connection. Upper connector 32 of direct connect sub 28 threadably connects with a corresponding internal connector of CCL 26 while lower connector 34 of direct connect sub 28 threadably connects to the outer sleeve 102 of upper perforating gun 100A.

The electrical connector 38 of direct connect sub 28 passes electrical power, signals, and/or data between CCL 26 and the perforating modules 200A-200C of upper perforating gun 100A. Additionally, electrical connector 38 seals a central throughbore or passage of the outer housing 30 of direct connect sub 28 whereby pressure within upper perforating gun 100A is prevented from being communicated uphole through direct connect sub 28 and into CCL 26 and other components of tool string 20 positioned uphole of CCL 26. Thus, electrical connector 38 may shield components of tool string 20 positioned uphole from upper perforating gun 100A from elevated pressures or shock waves generated by the detonation of shaped charges of upper perforating gun 100A during the operation of tool string 20.

In this embodiment, PSFH 40 generally includes an outer housing 42 and a switch assembly 48 positioned in outer housing 42. Outer housing 42 of PSFH 40 is generally cylindrical and includes an outer surface having an external first or upper connector 44 positioned at a first or upper end of outer housing 42 and an external second or lower connector 46 positioned at an opposing second or lower end of outer housing 42. In this embodiment, connectors 44, 46 each comprise threaded connectors configured for forming a threaded connection with a corresponding internal connector; however, in other embodiments, each may comprise other forms of connectors configured for forming a releasable connection. Upper connector 44 of PSFH 40 threadably connects with outer sleeve 102 of upper perforating gun 100A while lower connector 46 threadably connects to a corresponding internal connector of setting tool 50 (not shown in FIG. 2).

The switch assembly 48 of PSFH 40 passes electrical power, signals, and/or data between upper perforating gun 100A and setting tool 50 of tool string 20. Particularly, in response to the transmission of a setting tool firing signal (e.g., a firing signal specifically addressed to switch assembly 48) from the firing panel of surface assembly 11 to switch assembly 48, switch assembly 48 may ignite or fire an initiator 52 of setting tool 50 electrically connected to switch assembly 48 to thereby actuate or fire setting tool 50. Thus, switch assembly 48 may control the actuation of setting tool 50 based on signals transmitted to switch assembly 48 from the firing panel of surface assembly 11.

As described above, orientation sub 400 is generally configured to control the relative angular orientation between upper perforating gun 100A and lower perforating gun 1006. In some embodiments, orientation sub 400 comprises an upper housing 402, an electrical feed-thru assembly 415, a locking sleeve 420, and a lower housing 430. Upper housing 402 comprises a central throughbore or passage 404 and a generally cylindrical outer surface 406. Electrical feed-thru assembly 415 is received in the central passage 404 and is configured to provide electrical signal communication between upper perforating gun 100A and lower perforating gun 1006. Outer surface 406 comprises a first or upper connector 408 and a second or lower connector 410. Connectors 408, 410 may each comprise releasable connectors such as threaded connectors. Upper connector 408 is configured to couple to the outer sleeve 102 of upper perforating gun 100A. Additionally, an annular seal assembly 412 is positioned on outer surface 406 and is configured to sealingly engage an inner surface of lower housing 430.

Locking sleeve 420 of orientation sub 400 is disposed about housing 402 and between the outer housings 102 of perforating guns 100A, 100B. Locking sleeve 420 comprises an internal connector 422 configured to couple with the lower connector 410 of upper housing 402. Lower housing 430 of orientation sub comprises a first or upper internal connector 432 configured to couple to the lower connector 410 of upper housing 402 and a second or lower external connector 434 configured to couple to the outer sleeve 102 of lower perforating gun 1006. Connector 422 of locking sleeve 420 and connectors 432, 434 of lower housing 430 may each comprise releasable connectors, such as threaded connectors. During assembly of tool string 20, orientation sub may be used to adjust a relative angular orientation (relative central axis 25) of perforating guns 100A, 100B such that a preferred relative orientation may be achieved between guns 100A, 100B. Once the preferred relative orientation between perforating guns 100A, 100B is achieved, the relative orientation between perforating guns 100A, 100B may be locked by locking the orientation sub 400 such that relative rotation between perforating guns 100A, 100B is restricted. For example, following the coupling of locking sleeve 420 with lower housing 430 and upper housing 402, upper housing 402 may be coupled to upper perforating gun 100A. Lower perforating gun 1006 may then be coupled to lower housing 430. In this configuration, orientation sub 400 and lower perforating gun 100B may be rotated until the desired angular orientation between perforating guns 100A, 100B is achieved. Then locking sleeve 420 may be tightened against lower housing 430 to rotationally lock the upper perforating gun 100A to the lower perforating gun 1006.

Figure 3:
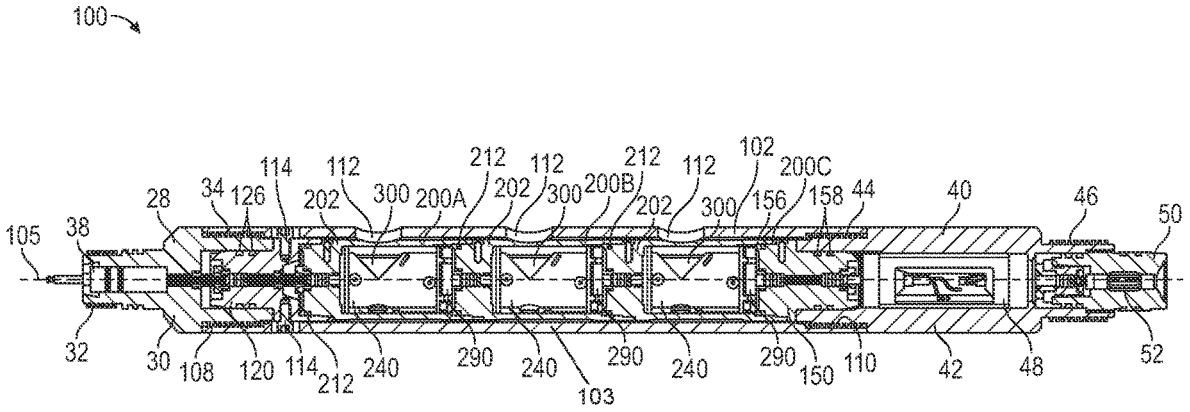
FIG. 3 is another side cross-sectional view of embodiments of a direct connect sub, a perforating gun, and a plug-shoot firing head in accordance with principles disclosed herein
Figure 4:
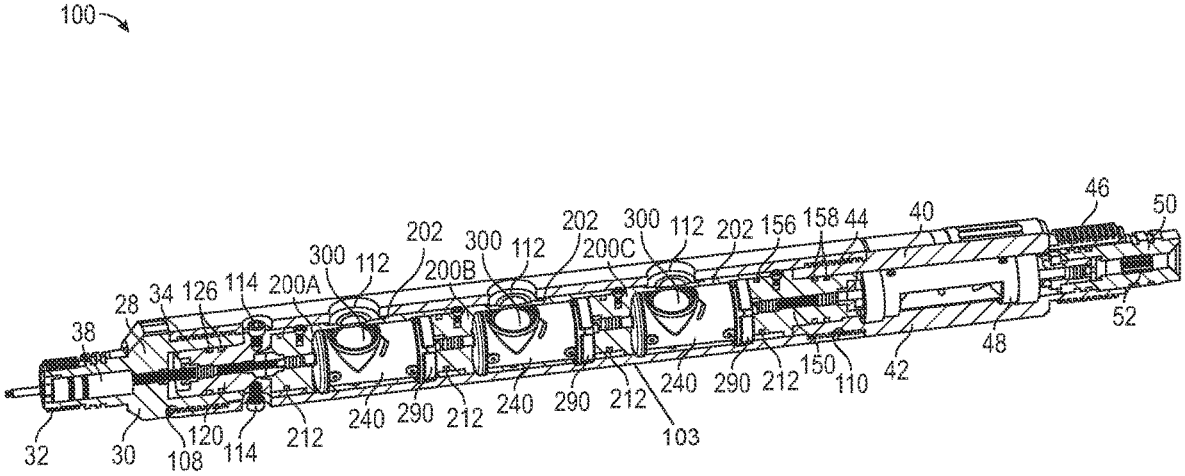
FIG. 4 is a perspective cross-sectional view of the direct connect sub, perforating gun, and plug-shoot firing head of FIG. 3.
Figure 5:
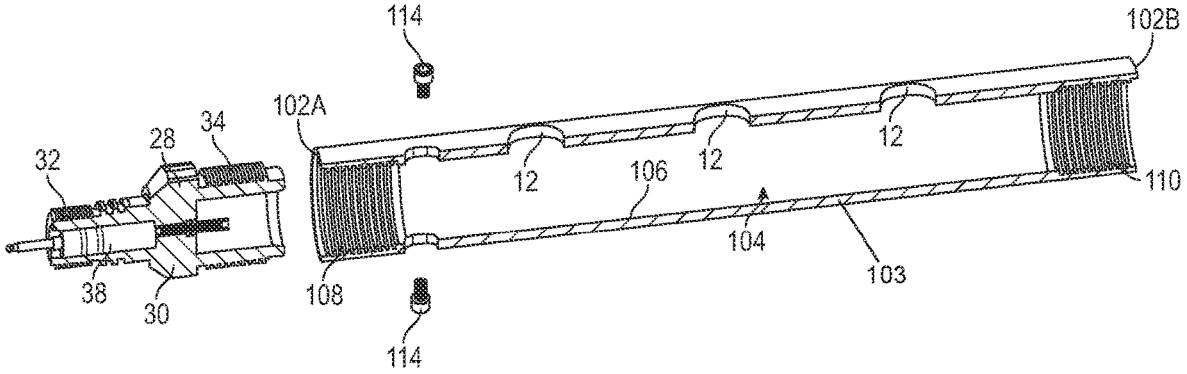
FIG. 5 is a perspective cross-sectional view of the direct connect sub and an embodiment of an outer sleeve of the perforating gun of FIG. 3 in accordance with principles disclosed herein.

In some embodiments, tool string 20 may only include a single perforating gun configured similarly as perforating guns 100A, 100B described above. For example, referring to FIGS. 3-5, an embodiment of a tool string comprising a single perforating gun 100 is shown. In some embodiments, perforating gun 100 is configured similarly as perforating guns 100A, 1006, and thus the discussion of perforating gun 100 below may pertain equally to perforating guns 100A, 100B. Perforating gun 100 includes an outer sleeve 102 in which pressure bulkheads 120, 150 and perforating modules 200A-200C are received. As shown particularly in FIG. 5, outer sleeve 102 of perforating gun 100 is generally cylindrical and has a first or upper end 102A, a second or lower end 102B opposite upper end 102A, a tubular wall structure 103, and a central passage or throughbore 104 defined by a generally cylindrical inner surface 106 of the tubular wall structure 103 extending between ends 102A, 102B. The inner surface 106 of outer sleeve 102 an internal first or upper connector 108 positioned at upper end 102A and an internal second or lower connector 110 positioned at lower end 102B of outer sleeve 102. Connectors 108, 110 connect the perforating gun 100 to other tools in the tool string 20 whereby tensile and compressive forces imposable on the perforating gun 100 as the perforating gun 100 is deployed in the wellbore 4 are carried by the outer sleeve 102 and not by the perforating modules 200A-200C received therein. In the embodiment of FIGS. 3-5, connectors 108, 110 each comprise releasable connectors (e.g., threaded connectors) configured for forming a releasable connection with a corresponding external connector; however, in other embodiments, each may comprise other forms of connectors configured for forming a releasable connection. In this embodiment, upper connector 108 of outer sleeve 102 threadably connects to the lower connector 34 of direct connect sub 28 (shown in FIG. 5 for context) while lower connector 110 threadably connects to the upper connector 44 of PSFH 40 (not shown in FIG. 5). A peripheral or outer surface of outer sleeve 102 may be exposed directly to the wellbore 4 and may at least partly define an exterior of the perforating gun 100.

In this embodiment, outer sleeve 102 of perforating gun 100 additionally includes a plurality of axially spaced radial perforations or ports 112, where each port 112 extends radially entirely through the inner surface 106 and an outer generally cylindrical surface of outer sleeve 102. Each port 112 is sized for an explosive jet from a shaped charge to pass through the wall structure 103 and then penetrate through casing string 12 inside the wellbore 4. As will be described further herein, ports 112 provide openings or passages through which the explosive jets discharged by the shaped charges of perforating gun 100 may be directed as the explosive jets travel towards casing string 12. Additionally, given that the outer sleeve 102 is not penetrated by the explosive jets, the outer sleeve 102 may be reused. In this embodiment, ports 112 are circumferentially aligned about a circumference of outer sleeve 102; however, in other embodiments, ports 112 may be circumferentially spaced about the circumference of outer sleeve 102 in a variety of arrangements. Given the presence of ports 112, the explosive jets need not physically penetrate outer sleeve 102 in order to escape upper perforating gun 100A. Additionally, in this embodiment, outer sleeve 102 includes a pair of circumferentially spaced openings through which fasteners or setting screws 114 may be inserted for axially locking upper pressure bulkhead 120 to outer sleeve 102.

Figure 6:
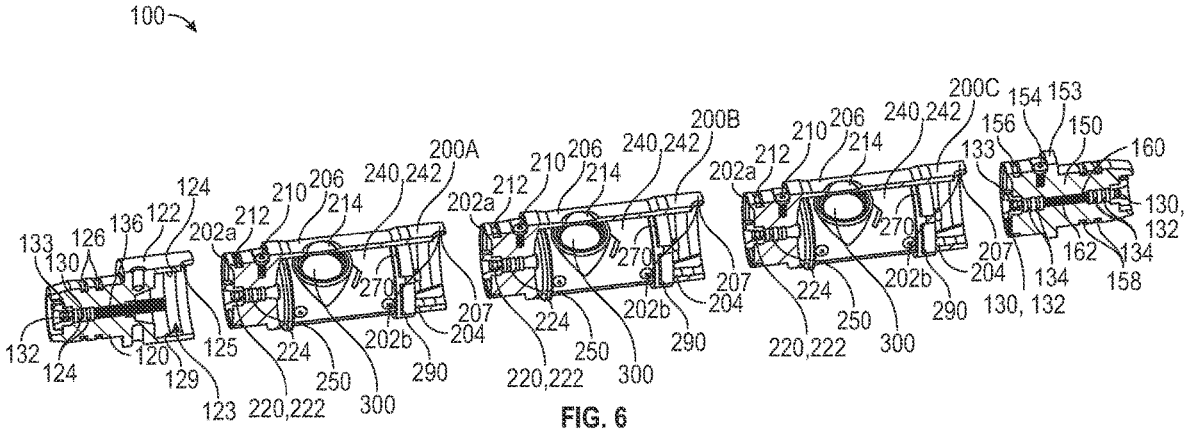
FIG. 6 is a perspective cross-sectional view of embodiments of an upper pressure bulkhead, a plurality of perforating assemblies, and a lower pressure bulkhead of the perforating gun of FIG. 3 in accordance with principles disclosed herein.
Figure 7:
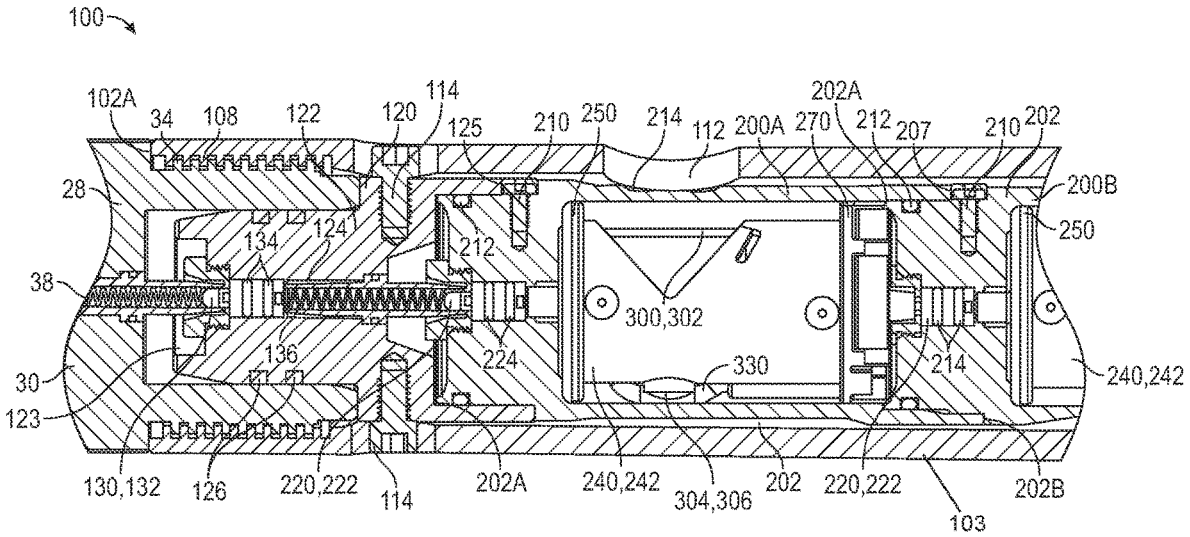
FIGS. 7, 8 are zoomed-in, side cross-sectionals view of the perforating gun of FIG. 3.
Figure 8:
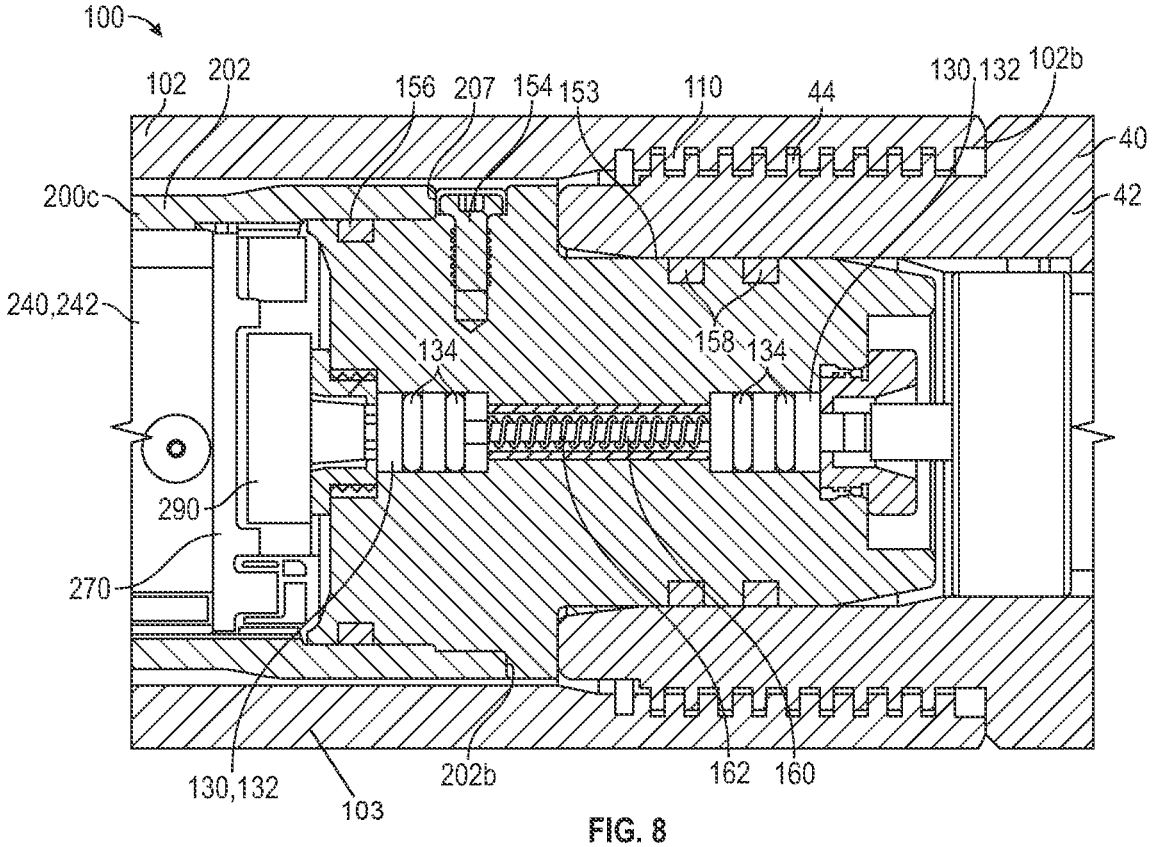
Figure 9:
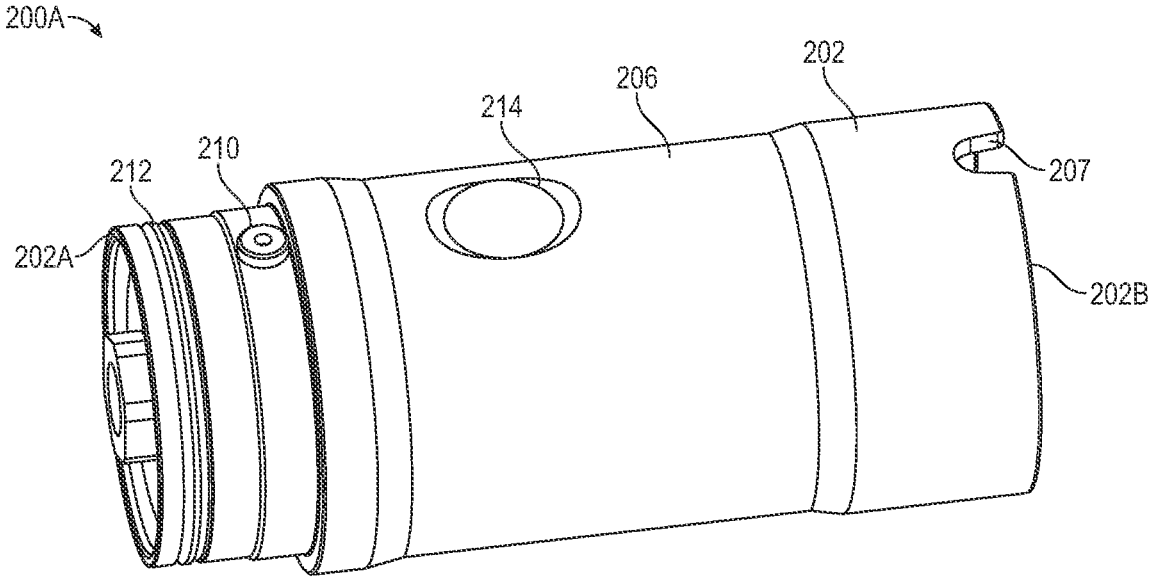
FIG. 9 is a perspective view of one of the perforating assemblies of FIG. 6.
Figure 10:
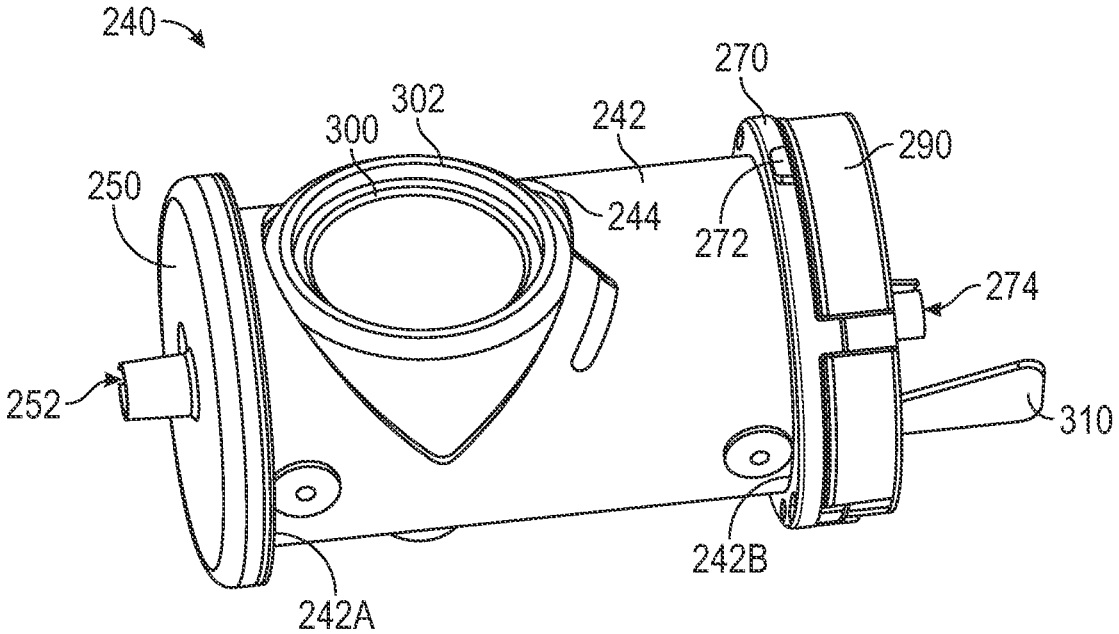
FIGS. 10, 11 are perspective views of an embodiment of a charge tube assembly of the perforating module of FIG. 9 in accordance with principles disclosed herein.
Figure 11:
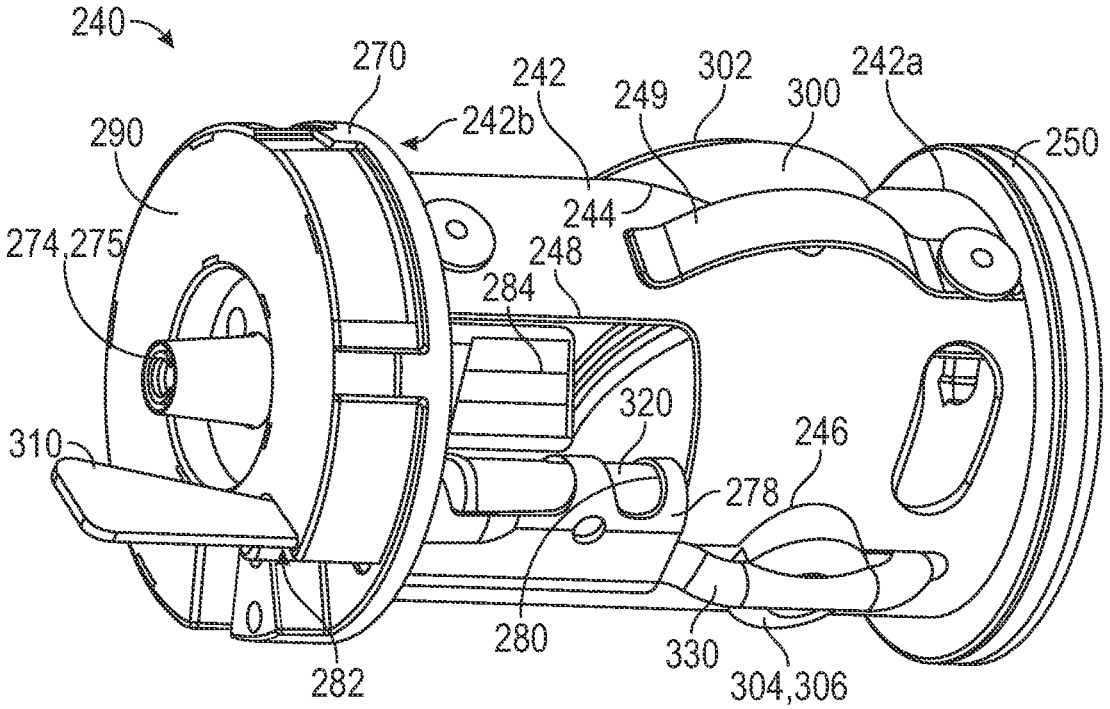
Figure 12:
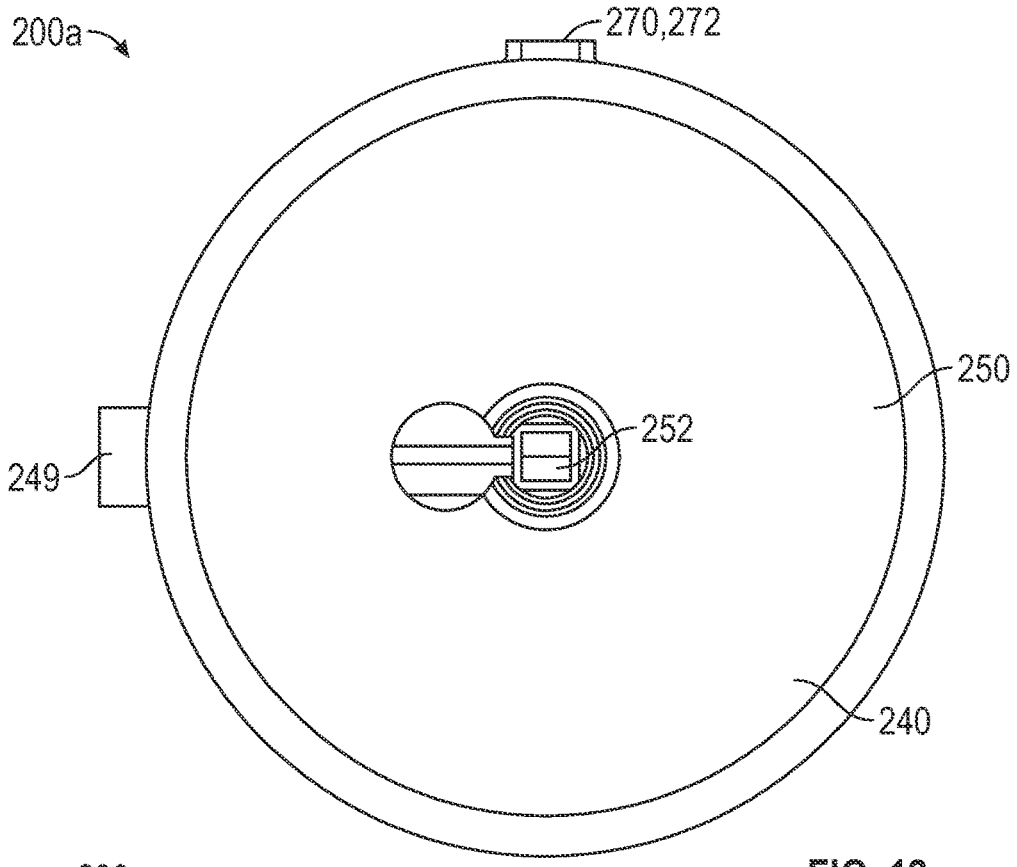
FIGS. 12, 13 are end views of the charge tube assembly of FIGS. 10, 11.
Figure 13:
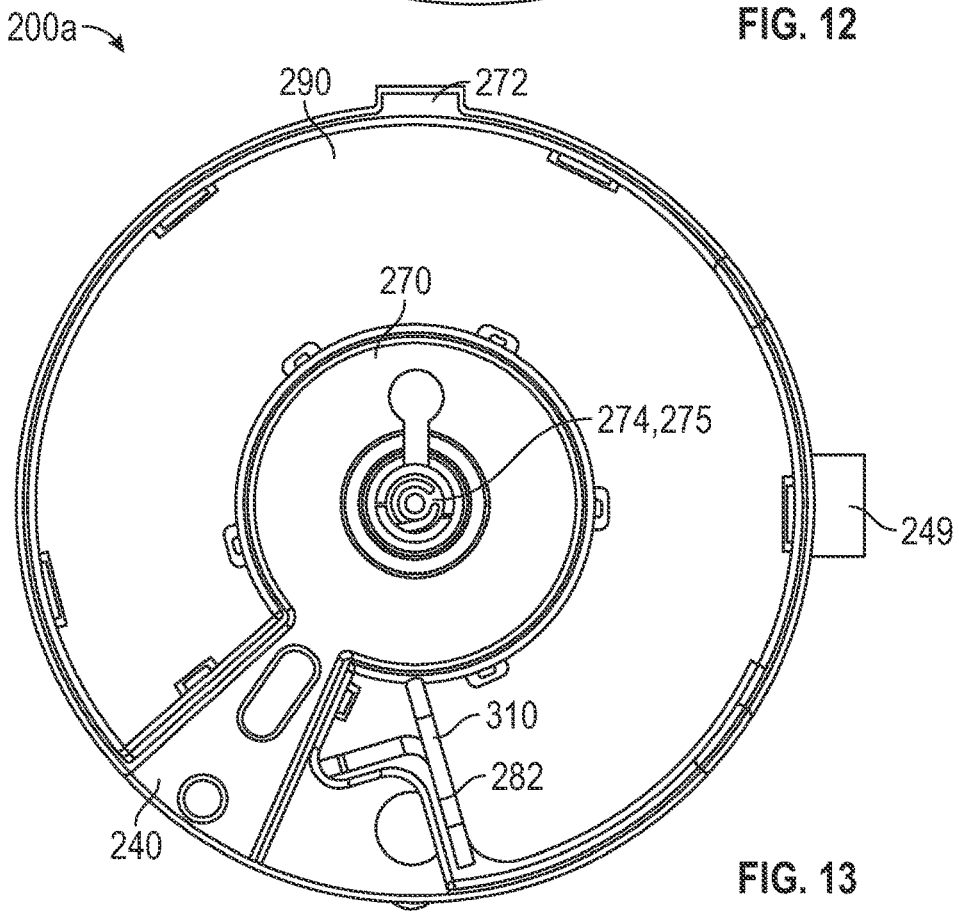

Referring to FIGS. 3, 4, 6-8, additional views of the pressure bulkheads 120, 150 of the perforating gun 100 of FIGS. 3, 4 are provided by FIGS. 6-8. In the embodiment of FIGS. 3, 4, and 6-8, upper pressure bulkhead 120 generally includes an outer housing 122 and an electrical connector assembly 130 received in the outer housing 122. Outer housing 122 is generally cylindrical and includes a central throughbore or passage 123 defined by a generally cylindrical inner surface 124 extending between first and second opposing ends of outer housing 122. Additionally, outer housing 122 includes a radial receptacle which extends entirely between inner surface 124 and an outer cylindrical surface of outer housing 122. In some embodiments, radial receptacle 125 is generally cylindrical in shape and extends along a longitudinal or central axis orthogonal to central axis 105. An end of upper perforating module 200A may be slidably received within the central passage 123 of outer housing 122.

Outer housing 122 of upper pressure bulkhead 120 additionally includes a pair of annular seals 126 (e.g., O-rings, etc.) disposed on an outer surface thereof which sealingly engage an inner cylindrical surface of the outer housing 30 of direct connect sub 28 whereby fluid communication between the central passage of outer housing 28 and the surrounding environment (e.g., wellbore 4) is restricted. Outer housing 122 further includes a pair of circumferentially spaced apertures which receive fasteners 114 for coupling and axially locking outer sleeve 102 with the outer housing 122 of upper pressure bulkhead 120. For instance, each fastener 114 may threadably engage an internal threaded connector formed in a corresponding aperture of outer housing 130. In this configuration, relative axial and rotational movement between upper pressure bulkhead 120 and outer sleeve 102 is restricted. In other embodiments, one or more circumferentially spaced apertures may be formed in the lower pressure bulkhead 150 which receive fasteners 114 to rotationally lock lower pressure bulkhead 150 to the outer sleeve 102.

The electrical connector assembly 130 of upper pressure bulkhead 120 is received in the central passage of outer housing 130 and is generally configured to transmit electrical power, signals, and/or data between direct connect sub 28 and the perforating modules 200A-200C of perforating gun 100. In this embodiment, electrical connector assembly 130 generally includes a connector body 132 having a pair of annular seals 134 (e.g., O-rings, etc.) positioned on an outer surface thereof, and a biasing member or spring contact assembly 136 electrically connected to connector body 132. In some embodiments, spring contact assembly 136 comprises a biasing member or spring (e.g., a coil spring) housed in an insulating sleeve sealably received in the central passage 123 of outer housing 122. Connector body 132 also includes a pin contact 133 extending from one end thereof. Seals 134 sealingly engage an inner surface of outer housing 130 whereby fluid communication is prevented across connector body 132. Connector body 132 has a first or upper end from which a contact pin extends which electrically contacts a biasing member or spring contact of the electrical connector assembly 38 of direct connect sub 28, and an opposing second or lower end from which spring contact assembly 136 extends.

Additionally, connector body 132 of electrical connector assembly 130 comprises a pair of annular shoulders which engage or contact a pair of corresponding internal shoulders of outer housing 130 whereby fluid pressure is restricted or inhibited from being communicated across connector body 132. Thus, connector body 132 is configured to inhibit or prevent elevated pressures and/or shock waves generated by the detonation of the shaped charges of perforating gun 100 from being communicated to components of tool string 20 positioned uphole of perforating modules 200A-200C, including components of CCL 26, direct connect sub 28, etc.

In this embodiment, lower pressure bulkhead 150 generally includes an outer housing 152 and an electrical connector assembly 160 received in the outer housing 152. Outer housing 152 is generally cylindrical and includes a central throughbore or passage defined by a generally cylindrical outer surface 153 extending between first and second opposing ends of outer housing 152. A radial lock 154 is disposed in an aperture of outer housing 152 proximal a first or upper end of outer housing 152 whereby radial lock 154 projects radially outwards from outer surface 153. In some embodiments, radial lock 154 comprises a cylindrical member such as a fastener. In other embodiments, lower pressure bulkhead 150 may alternatively include a threaded or bayonet connector in lieu of radial lock 154.

Outer housing 152 of lower pressure bulkhead 150 additionally includes a first or upper annular seal 156 (e.g., O-ring, etc.) and a pair of second or lower annular seals 158 (e.g., O-rings, etc.) each disposed on an outer surface thereof. Upper annular seal 156 sealingly engages an inner cylindrical surface of lower perforating module 200C, and the pair of lower annular seals 158 sealingly engage an inner surface of the outer housing 42 of PSFH 40 to restrict fluid communication between the central passage of outer housing 42 and the surrounding environment (e.g., wellbore 4).

The electrical connector assembly 160 of lower pressure bulkhead 150 is received in the central passage of outer housing 160 and is generally configured to transmit electrical power, signals, and/or data between perforating gun 100 and PSFH 40. In this embodiment, electrical connector assembly 160 generally includes biasing member or spring contact 162 extending between, and in electrical contact with, a pair of connector bodies 132 and associated annular seals 134, where the annular seals 134 of each connector body 132 sealingly engage the inner surface of outer housing 152. In this embodiment, a first or upper of the connector bodies 132 of electrical connector assembly 160 is oriented such that the pin contact 133 of connector body 132 extends towards perforating modules 200A-200C to form an electrical connection therewith while a second or lower of the connector bodies 132 of assembly 160 extends towards PSFH 40 to form an electrical connection therewith. The installation of perforating modules 200A-200C within outer sleeve 102 is configured to substantially eliminate the transfer of tensile and/or compressive forces imposable on or by the tool string 20 onto the perforating modules 200A-200C. Similar to the arrangement of the connector body 132 of electrical connector assembly 130 described above, each of the connector bodies 132 of electrical connector assembly 160 is positioned between a pair of shoulders of the outer housing 152 of lower pressure bulkhead 150 whereby pressure is inhibited or restricted from being communicated across the connector bodies 132 of electrical connector assembly 160. Thus, electrical connector assembly 160 shields components of tool string 20 positioned downhole of perforating gun 100 (e.g., PSFH 40, setting tool 50, and plug 60, etc.) from elevated pressures and/or shock waves generated by the detonation of the shaped charge of perforating gun 100.

Referring to FIGS. 3-15, additional views of one of the perforating modules 200A-200C (labeled as "200A" in FIGS. 9-15 for the sake of convenience) of the perforating gun 100 of FIGS. 3, 4 are provided in FIGS. 9-15. In the embodiment of FIGS. 3-15, perforating gun 100 includes three similarly configured perforating modules 200A-200C, each perforating module 200A-200C being slidably received in the outer sleeve 102 of perforating gun 100; however, in other embodiments, perforating gun 100 may comprise a varying number of perforating modules 200 (e.g., 4 to 75 or more perforating modules 200, for example), including only a single perforating module 200 housed within an outer sleeve similar in configuration to outer sleeve 102. In this embodiment, each perforating module 200A-200C generally includes an outer housing or carrier 202, a charge tube assembly 240 housed within the carrier 202, where charge tube assembly 240 includes an individually addressable electrical or digital switch assembly 290 and a shaped charge 300 extending longitudinally at a non-zero angle (e.g., orthogonal) a central axis of the outer sleeve 102. Switch assembly 290 allows for the shaped charges 300 to be detonated in a sequential and selectable firing of the individual perforating modules 200A-200C. Although in this embodiment each perforating module 200A-200C includes a single shaped charge 300, in other embodiments, each perforating module 200A-200C may include a plurality of shaped charges 300. Shaped charges 300 in this embodiment have a 0° phasing (i.e., charges 300 are not circumferentially spaced from each other); however, in other embodiments, the phasing of shaped charges may vary. Additionally, each shaped charge 300 is oriented in substantial alignment with one of the ports 112 of outer sleeve 102.

As shown particularly in FIGS. 6-8, the carrier 202 of each perforating module 200A-200C has a first or upper end 202A, a second or lower end 202B opposite upper end 202A, a central bore or passage 203 defined by a generally cylindrical inner surface 204 extending between ends 202A, 202B, and a generally cylindrical outer surface 206 extending between ends 202A, 202B. The outer surface 206 of carrier 202 includes a radial lock 210 positioned proximal the upper end 202A. Radial lock 210 projects radially outers from the outer surface 206 of carrier 202. The central passage 203 of the carrier 202 may comprise an interior of the perforating module 200A which is sealed from the central passage 104 of the outer sleeve 102. In some embodiments, radial lock 210 comprises a cylindrical member such as a fastener. Additionally, a radial receptacle 207 extends entirely through outer surface 206 at the lower end 202B of carrier 202.

Upon assembly of perforating gun 100, the radial lock 210 of upper perforating module 200A is received in the radial receptacle 125 of upper pressure bulkhead 120, the radial lock 210 of central perforating module 200B is received in the radial receptacle 207 of upper perforating module 200A, the radial lock 210 of lower perforating module 200C is received in the radial receptacle 207 of central perforating module 200B, and the radial lock 154 of lower pressure bulkhead 150 is received in the radial receptacle 207 of lower perforating module 200C. In this arrangement, upper pressure bulkhead 120, perforating modules 200A-200C, and lower pressure bulkhead 150 are rotationally locked such that relative rotation between bulkheads 120, 150 and perforating modules 200A-200C is restricted. Additionally, via the locking provided by radial locks 154, 210, pressure bulkheads 120, 150 and perforating modules 200A-200C need not be threaded together during the assembly of perforating gun 100 in order to restrict relative rotation therebetween, thereby minimizing the time required to assemble perforating gun 100. In this embodiment, radial locks 210 have a 0° phasing whereby they are not circumferentially spaced from each other; however, in other embodiments, the phasing of radial locks 210 may vary in order to provide a desired phasing of shaped charges 300.

Instead, for example, following the coupling of lower pressure bulkhead 150 with outer sleeve 102, lower perforating module 200C may be slid over and onto the lower pressure bulkhead 150 such that lower pressure bulkhead 150 is received in the central passage 203 of the carrier 202 of lower perforating module 200C with radial lock 154 received in the radial receptacle 207 of lower perforating module 200C. Similarly, following the insertion of lower pressure bulkhead 150 into lower perforating module 200C, central perforating module 200C may be slid over and onto lower perforating module 200C such that lower perforating module 200C is received in the central passage 203 of the carrier 202 of central perforating module 200B with radial lock 210 of lower perforating module 200C received in the radial receptacle 207 of central perforating module 200B. Further, following the insertion of lower perforating module 200C into central perforating module 200B, upper perforating module 200A may be slid over and onto central perforating module 200B such that central perforating module 200B is received in the central passage 203 of the carrier 202 of upper perforating module 200A with radial lock 210 of central perforating module 200B received in the radial receptacle 207 of upper perforating module 200A.

Finally, upper pressure bulkhead 120 may be slid over and onto upper perforating module 200A such that upper perforating module 200A is received in the central passage 123 of upper pressure bulkhead with radial lock 210 of upper perforating module 200A received in the radial receptacle 125 of upper pressure bulkhead 120. Upper pressure bulkhead 120 may in turn be rotationally locked to outer sleeve 102 via fasteners 114, thereby rotationally locking perforating modules 200A-200C with outer sleeve 102 whereby relative rotation between outer sleeve 102 and perforating modules 200A-200C is restricted. While slidably locking perforating modules 200A-200C together via radial locks 210 and corresponding radial receptacles 207 may reduce the time required for assembling perforating gun 100 relative to threadably coupling the perforating modules 200A-200C together, in other embodiments, other mechanisms may be utilized to couple perforating modules 200A-200C together into a manner in which relative rotation is restricted between both perforating modules 200A-200C and between perforating modules 200A-200C and outer sleeve 102.

In this embodiment, the outer surface 206 of carrier 202 also includes an annular seal 212 (e.g., an O-ring, etc.) positioned thereon and a scallop or indentation 214 which extends partially into outer surface 206. The annular seal 212 of upper perforating module 200A sealingly engages the inner surface 123 of upper pressure bulkhead 120 whereas the annular seals 212 of the remaining two perforating modules 200B, 200C sealingly engage the inner surface 204 of an adjacently positioned carrier 202. The scallop 214 of carrier 202 is circumferentially and axially aligned with a central axis of the shaped charge 300 of the perforating module 200A-200C whereby the detonation of the shaped charge 300 causes the explosive jet to penetrate the scallop 214 of carrier 202. The reduced wall-thickness provided by scallop 214 assists with the operation of shaped charge 300 in penetrating casing string 12 following the detonation of the shaped charge 300. The outer surface 206 of carrier 202 also includes a section of reduced outer diameter spanning a central region of outer surface 206 which includes scallop 214. The reduced outer diameter section provides an increased radial gap between the outer surface 206 of carrier 202 and the inner surface of outer sleeve 102 in the region of carrier 202 which will swell the greatest following the detonation of shaped charge 300. The increased radial gap may ensure that perforating modules 200A-200C may be removed the outer sleeve 102 after the detonation of shaped charges 300. The radial locks 210 of carriers 202 may be sized or otherwise configured whereby the scallops 214 of perforating modules 200A-200C circumferentially align when the carriers 202 of perforating modules 200A-200C are assembled with pressure bulkheads 120, 150. Additionally, as described above, the phasing of radial locks 210 may be tailored to provide a desired phasing of shaped charges 300.

The carrier 202 of each perforating module 200A-200C also includes an electrical connector assembly 220 positioned in hub 215 and which comprises a connector body 222 and a pair of annular seals 224 positioned on an outer surface thereof and which sealingly engage the inner surface 204 of carrier 202. As will be described further herein, electrical connector assemblies 220 provide electrical connectivity whereby electrical power, signals, and/or data may be transmitted between perforating modules 200A-200C. Additionally, in some embodiments, connector body 222 is positioned between corresponding shoulders of the inner surface 204 of carrier 202 such that pressure is impeded or prevented from being communicated across connector body 222.

Thus, in some embodiments, electrical connector assembly 220 comprises a pressure bulkhead which isolates the central passage 203 of each carrier 202 from the remaining perforating modules 200A-200C of perforating gun 100. By isolating each perforating module 200A-200C from pressure generated by the remaining perforating modules 200A-200C, each perforating module 200A-200C may be actuated independently of each other without damaging or otherwise impeding the operation of the remaining perforating modules 200A-200C. For example, by isolating the upper and central perforating modules 200A, 200B from pressure generated by lower perforating module 200C, the shaped charge 300 of the lower perforating module 200C may be detonated without damaging or otherwise impeding the future operation of the upper and central perforating modules 200A, 200B of perforating gun 100. By having the ability to selectively fire only a single perforating module 200A-200C, a single perforating gun 100 may be used to perforate casing string 12 at a plurality of locations in wellbore 4.

For the sake of convenience, perforating module 200A is described below. However, as previously stated, perforating modules 200A-200C are each similarly configured, and thus the discussion of perforating module 200A below is equally applicable to perforating modules 200B, 200C. The charge tube assembly 240 of perforating module 200A generally includes a generally cylindrical charge tube 242, a first or upper endplate 250, a second or lower endplate 270, switch assembly 290, shaped charge 300, and a detonator 320. As shown particularly in FIGS. 10-15, charge tube 242 has a first or upper end 242A coupled to upper endplate 250, and an opposing second or lower end 242B coupled to lower endplate 270. Endplates 250, 270 may be coupled to the ends 242A, 242B of charge tube 242 via a variety of mechanisms, including rivets, threaded fasteners, tabs integral to the endplates 250, 270 that snap into the charge tube 242, etc. In some embodiments, charge tube 242 and endplates 250, 270 may each comprise a metallic material, a plastic material, or combinations thereof. Additionally, in some embodiments, charge tube 242 may be formed monolithically with endplates 250, 270.

Charge tube 242 includes a first radial opening or aperture 244 through which a longitudinal first end 302 (from which the explosive jet is directed following the detonation of shaped charge 300) of the shaped charge 300 projects, and a second radial opening or aperture 246 circumferentially spaced from first radial opening 244 through which a longitudinal second end 304 of shaped charge 300 projects whereby shaped charge 300 is secured to charge tube 242. As will be discussed further herein, charge tube 242 comprises an arcuate slot 248 which extends from lower end 242B towards upper end 242A. Additionally, charge tube 242 also comprises a ground spring 249 which extends radially outwards from an outer surface of charge tube 242. In some embodiments, charge tube 242 may comprise a plurality of ground springs 249 spaced circumferentially about the circumference of charge tube 242. In some embodiments, an electrical cable or signal conductor (not shown in FIGS. 9-15) extends from ground spring 249 and is electrically connected to the switch assembly 290 of upper perforating module 200A thereby connecting ground paths of all switch assemblies 290.

The upper endplate 250 of charge tube assembly 240 is disc-shaped and comprises a centrally positioned electrical connector or socket 252 that electrically connects to the electrical connector assembly 220 of perforating module 200A. For instance, a pin connector extending from the connector body 222 of the electrical connector assembly 220 may extend into electrical socket 252. Electrical socket 252 may comprise one or more inwardly biased pins to secure the pin connector of connector body 222 within electrical socket 252 such that only a predetermined axial force applied to one of carrier 202 and charge tube assembly 240 may disconnect connector body 222 from electrical socket 252. An electrical cable or signal conductor (not shown in FIGS. 9-15) extends from electrical socket 252 and is electrically connected to the switch assembly 290 of upper perforating module 200A whereby electrical power, signals, and/or data may be transmitted between electrical connector assembly 220 and switch assembly 290.

Lower endplate 270 of charge tube assembly 240 is disc-shaped and comprises a radially outwardly extending tab 272 that is received in a slot formed in the inner surface 204 of carrier 202 whereby relative rotation between charge tube assembly 240 and carrier 202 is restricted. Lower endplate 270 additionally includes a centrally positioned electrical connector assembly 274 which comprises a biasing member or spring contact 275 extending axially from charge tube 242 and a pin contact 276 electrically connected to spring contact 275 and which extends into charge tube 242. An electrical cable or signal conductor (not shown in FIGS. 9-15) extends from pin contact 276 and is electrically connected to the switch assembly 290 of upper perforating module 200A whereby electrical power, signals, and/or data may be transmitted between switch assembly 290 and central perforating module 200B of perforating gun 100. When perforating gun 100 is assembled, spring contact 275 of perforating module 200A is biased into electrical contact with the pin connector of the electrical connector assembly 220 of central perforating module 200B, thereby providing an electrical connection between upper perforating module 200A and central perforating module 200B. Similarly, the spring contact 275 of the lower endplate 270 of central perforating module 200B is biased into contact with the pin connector of the electrical connector assembly 220 of lower perforating module 200C, thereby providing an electrical connection between central perforating module 200B and lower perforating module 200C. Finally, the spring contact 275 of the lower endplate 270 of lower perforating module 200C is biased into contact with the pin connector of the electrical connector assembly 130 of lower pressure bulkhead 150, thereby providing an electrical connection between lower perforating module 200C and lower pressure bulkhead 150.

In this embodiment, lower endplate 270 additionally includes a detonator or "det" pack or det holder 278 which extends axially towards upper endplate 250 and may be at least partially received in the arcuate slot 248 of charge tube 240. Det holder 278 comprises a first or detonator receptacle 280 which receives generally cylindrical detonator 320, a second or detcord receptacle 281 which receives at least a portion of a cylindrical detonator cord or detcord 330, and a third or interrupter receptacle 282 (positioned between receptacles 280, 281) which receives a detonator interrupt 310. Each of receptacles 280, 281, and 282 extend along axes parallel with a central or longitudinal axis of charge tube 240, and do not project radially outwards from lower endplate 270. Detonator 320 is configured to ignite or detonate in response to receiving a firing signal from switch assembly 290.

In this embodiment, lower endplate 270 further includes a wiring harness 284 that is received within charge tube 242. As shown particularly in FIG. 14, wiring harness 284 comprises three separate electrical connectors in this embodiment, a first electrical connector 285 which receives the electrical cable extending from electrical socket 252 of upper endplate 250, a second electrical connector 287 which receives the electrical cable extending from pin contact 276 of lower endplate, and a third electrical connector 289 from which an electrical cable or signal conductor (not shown in FIGS. 9-15) extends that is coupled to the ground spring 249.

The switch assembly 290 of perforating module 200A in this embodiment may be disc shaped (e.g., C-shaped) having a central opening through which electrical connector 274 may extend. Switch assembly 290 may comprise a printed circuit board (PCB) upon which a digital circuit comprising one or more processors and one or more memory devices are provided. As shown particularly in FIG. 15, switch assembly 290 may be releasably coupled to an external, annular face 286 of lower endplate 270 via a retaining mechanism or clip 288 of lower endplate 270. The thin, disc shape of switch assembly 290 serves to minimize the axial length of perforating module 200A, thereby minimizing the overall axial length of perforating gun 100, making the perforating gun 100 easier to transport through wellbore 4. While in this embodiment switch assembly 290 is positioned external of charge tube 242, in other embodiments, the switch assembly of perforating module 200A may be received within charge tube 242.

Figure 14:
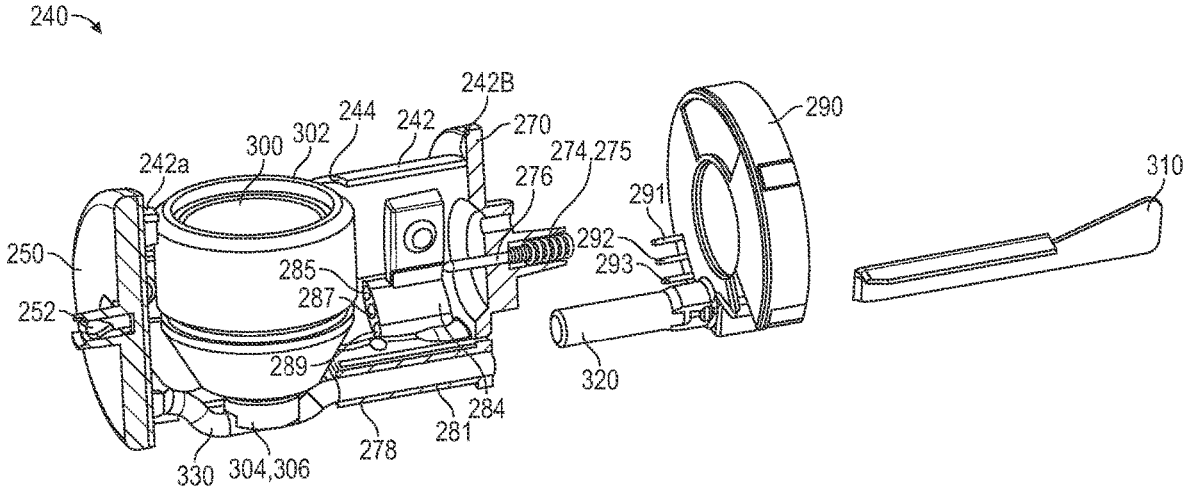
FIGS. 14, 15 are partial cross-sectional views of the charge tube assembly of FIGS. 10, 11.
Figure 15:
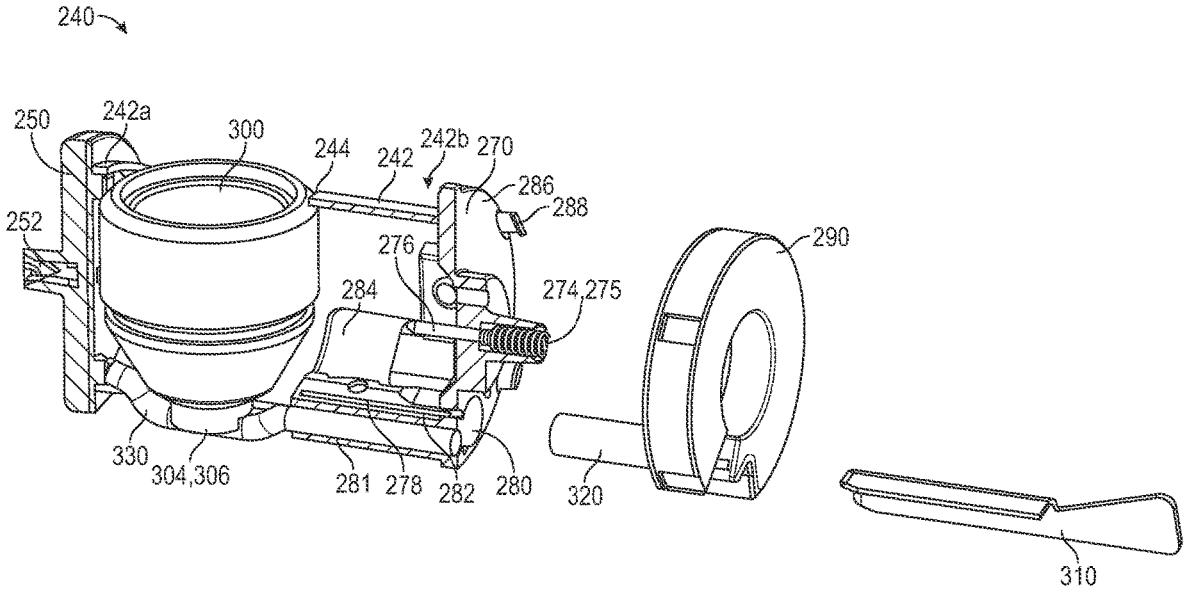

As shown particularly in FIG. 14, switch assembly 290 comprises a plurality of pin contacts 291, 292, and 293 which electrically connect and are received within the electrical connectors 285, 287, and 289, respectively, of wiring harness 284 to provide signal communication between electrical connector assemblies 252, 274, ground spring 249, and switch assembly 290. Additionally, detonator 320 may be coupled directly to switch assembly 290 (instead of, e.g., being connected by one or more electrical cables) such that detonator 320 may be inserted into detonator receptacle 280 of lower endplate 270 as switch assembly 290 is coupled to the external face of lower endplate 270.

Detcord 330 of charge tube assembly 240 extends from detcord receptacle 281 to a pair of forks 306 defining the second end 304 of shaped charge 300 to ballistically couple detonator 320 with shaped charge 300. In this configuration, the detonation of detonator 320 in response to receiving an appropriate firing signal from switch assembly 290 causes detcord 330 to ignite or detonate, which in-turn ignites or detonates the shaped charge 300 of perforating module 200A. Interrupter 310 is slidably received in interrupter receptacle 282 of lower endplate 270. Interrupter 310 is configured to selectably block or interrupt the ballistic coupling between detonator 310 and detcord 330 so that perforating module 200A may be safely transported between a location of the assembly of perforating module 200A (located remotely from wellbore 4) and the site of wellbore 4. Particularly, interrupter 310 may be inserted into interrupt receptacle 281 prior to transporting perforating module 200A to the site of wellbore 4. With interrupter 310 received in interrupt receptacle 281, interrupter 310 serves to prevent the ignition or detonation of detcord 330 following an inadvertent detonation of detonator 320 so that shaped charge 300 is not inadvertently fired. After arriving at wellbore 4, and prior to the final assembly and running of perforating gun 100 into wellbore 4, interrupter 310 may be removed from interrupt receptacle 281 to allow for the ballistic coupling of detonator 320 and detcord 330 whereby detcord 330 will ignite following the ignition of detonator 320. In this embodiment, interrupter 310 comprises an elongate strip formed from a metallic material; however, in other embodiments, the configuration of interrupter 310 may vary. In still other embodiments, upper perforating module 200A may not include an interrupter.

In this embodiment, ground spring 249, which is electrically connected with charge tube 242, is biased into physical contact with the inner surface 204 of the carrier 202 of upper perforating module 200A to provide a ground path between ground spring 320 and carrier 202. The ground path may further extend uphole from carrier 202 via physical contact between the carrier 202 of upper perforating module 200A and upper pressure bulkhead 120, and physical contact between upper pressure bulkhead 120 and direct connect sub 28. Switch assembly 290 may also be grounded to carrier 202 of upper perforating module 200A via the electrical cable extending between the third electrical connector 289 (electrically connected to switch assembly 290) of wiring harness 284 and ground spring 249 which is coupled to (e.g., riveted, etc.) to charge tube 242 of charge tube assembly 240.

In this embodiment, the switch assemblies 290 of perforating modules 200A-200C are individually addressable by the firing panel of surface assembly 11 for detonating their respective shaped charges 300. For example, once perforating gun 100 is positioned in wellbore 4, the firing panel of surface assembly 11 may assign each switch assembly 290 of perforating modules 200A-200C with a unique identifier so that the firing panel may communicate selectably between each perforating module 200A-200C. Thus, following the assignment of identifiers to switch assemblies 290 of perforating modules 200A-200C, perforating gun 100 may be positioned at a first location within wellbore 4. With perforating gun 100 positioned at the first location, the firing panel may instruct only lower perforating module 200C to fire, causing the shaped charge 300 of lower perforating module 200C to detonate and thereby perforate casing string 12 at the first location in wellbore 4. Following the perforation of casing string 12 at the first location, perforating gun 100 may be transported uphole towards the surface 5 until perforating gun 100 is positioned in a second location in wellbore 4 which is spaced from the first location. With perforating gun 100 positioned at the second location, the firing panel may instruct only central perforating module 200B to fire, causing the shaped charge 300 of central perforating module 200B to detonate and thereby perforate casing string 12 at the second location in wellbore 4. Finally, following the perforation of casing string 12 at the second location, perforating gun 100 may be transported uphole towards the surface 5 until perforating gun 100 is positioned in a third location in wellbore 4 which is spaced from the first and second locations. With perforating gun 100 positioned at the third location, the firing panel may instruct only upper perforating module 200A to fire, causing the shaped charge 300 of upper perforating module 200A to detonate and thereby perforate casing string 12 at the third location in wellbore 4.

As described above, the pressure isolation provided by electrical connector assemblies 220 of perforating modules 200A-200C allow for the sequential and selectable detonating of individual perforating modules 200A-200C. Thus, perforating gun 100 allows for casing string 12 to be selectably perforated at a plurality of locations therealong utilizing only a single perforating gun rather than an assembly of multiple perforating guns connected together along a common tool string, providing advantages in terms of reducing the axial length of the tool string 20 along which perforating gun 100 is deployed whereby the costs of manufacturing tool string 20 and increasing the ease and convenience of deploying tool string 20 through wellbore 4 relative to conventional tool strings comprising conventional assemblies of perforating guns.

Additionally, given that none of pressure bulkheads 120, 150, and perforating modules 200A-200C are threadably connected to either direct connect sub 28 or PSFH 40, outer sleeve 102 is configured to withstand the substantial entirety of the tension and compressive loads applied to perforating gun 100 during operation. In other words, tensile or compressive loads applied to perforating gun 100 extend along an axially directed (e.g., a direction of the load extending parallel with central axis 105) load path that extends through direct connect sub 28, outer sleeve 102, and PSFH 40. In this configuration, the tensile/compressive load path does not extend through either pressure bulkheads 120, 150 or perforating modules 200A-200C, thereby isolating pressure bulkheads 120, 150, and perforating modules 200A-200C from tensile and compressive loads applied to perforating gun 100 during operation. Given that perforating modules 200A-200C need not withstand the full tension and compressive loads applied to perforating gun 100, the axial length of each perforating module 200A-200C may be minimized (e.g., the diameter of each radial lock 210 and corresponding radial receptacle 207 may be minimized due to the absence of a threaded or bayonet connection, for example). Additionally, the wall thickness of the carriers 202 of perforating modules 200A-200C may also be reduced in view of the reduced loading applied to perforating modules 200A-200C. Moreover, isolating pressure bulkheads 120, 150 and perforating modules 200A-200C from the tensile/compressive load path has the benefit of separating the load bearing components of perforating gun 100 (outer sleeve 102 in this embodiment) from the pressure containing components (pressure bulkheads 120, 150, and perforating modules 200A-200C in this embodiment), allowing the design (e.g., geometry, sizing, materials, etc.) of the load bearing components and the pressure retaining components of perforating gun 100 to be optimized for their respective functions.

Perforating gun 100 also provides additional advantages other than the minimization of the axial length of perforating gun 100 and tool string 20 relative to conventional system. For instance, given the modularity of perforating modules 200A-200C (each perforating module 200A, 200B, and 200C being similarly configured), the number of perforating modules 200A-200C, number of shaped charges 300 housed within a given perforating module 200A-200C, the phasing of each shaped charge 300, and the phasing of each perforating module 200A-200C may be easily tailored to the particular application, with only the axial length, number of ports 112, and phasing of the ports 112 of outer sleeve 102 needing to be adjusted to account for changes in the number and configuration of perforating modules 200A-200C used in the perforating gun 100. Perforating gun 100 also provides additional advantages of, for example, the ability to remove perforating modules 200A-200C from outer sleeve 102 following the detonation of shaped charges 300 and retrieval of perforating gun 100 from wellbore 4 so that outer sleeve 102 may be refurbished. Another exemplary advantage of perforating gun 100 is that perforating modules 200A-200C have an outer diameter that is less than an internal diameter of outer sleeve 102 such that modules 200A-200C may be removed from outer sleeve 102 after the detonation of shaped charges 300 (i.e., the diameter is small enough such that modules 200A-200C do not become jammed in outer sleeve 102). Additionally, the position of scallop 114 with respect to the outer diameter of outer diameter of outer sleeve 102 may provide a reduced burr height that ensures perforating gun 100 will not become jammed in wellbore 104.

Figure 16:
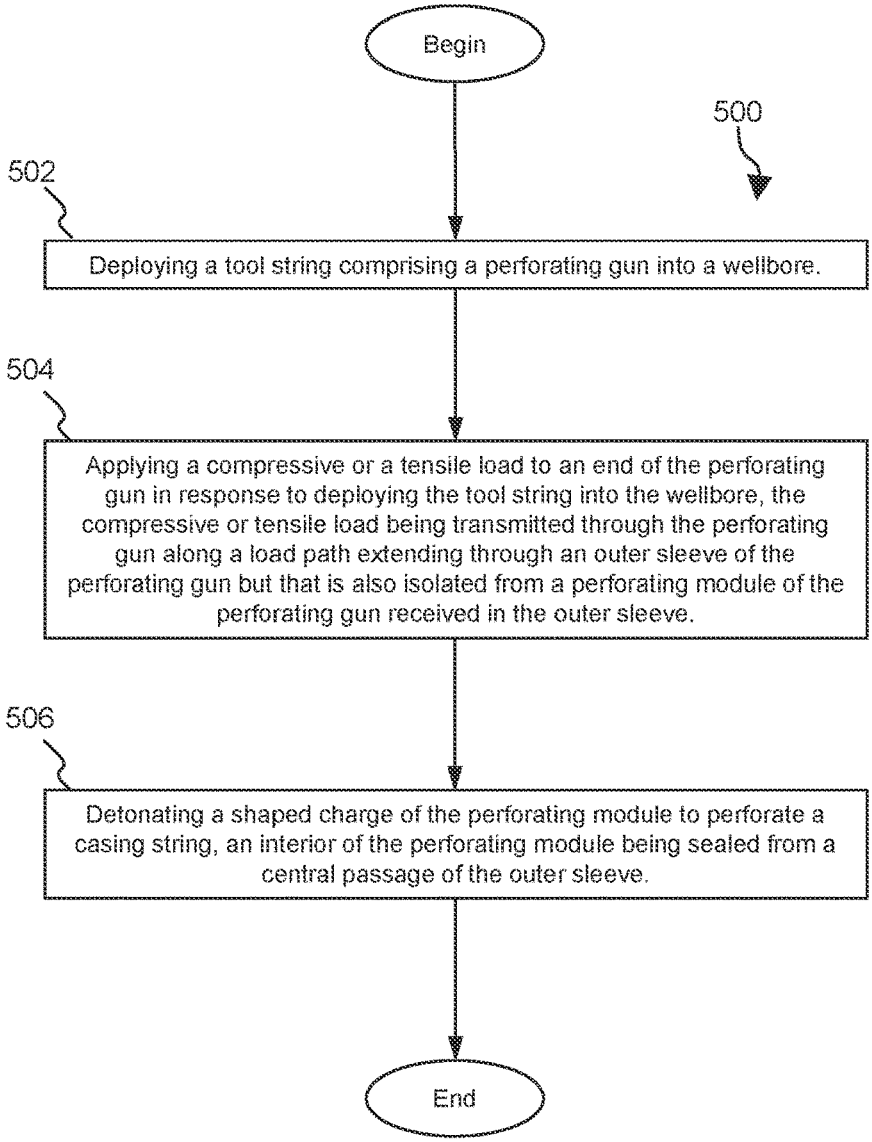
FIG. 16 is a flowchart illustrating a method for perforating a casing string positioned in a wellbore in accordance with principles disclosed herein.

Referring to FIG. 16, a flowchart illustrating a method 500 for perforating a casing string positioned in a wellbore is shown. Initially, method 500 includes deploying a tool string comprising a perforating gun into the wellbore at block 502. In some embodiments, block 502 includes deploying tool string 20 or the tool string comprising perforating gun 100 into the wellbore 4 shown in FIG. 1. Method 500 includes applying a compressive or a tensile load to an end of the perforating gun in response to deploying the tool string into the wellbore, the compressive or tensile load being transmitted through the perforating gun along a load path extending through an outer sleeve of the perforating gun but that is also isolated from a perforating module of the perforating gun received in the outer sleeve at block 504. In some embodiments, block 504 comprises applying a compressive or tensile load to either the direct connect sub 28 or the PSFH 40 shown in FIG. 3, and transferring the compressive or tensile load to the outer sleeve 102 of the perforating gun 100 shown in FIG. 3, the load being transmitted through perforating gun 100 along a load path extending through outer sleeve 102 but that is also isolated from the perforating modules 200A-200C.

Method 500 further includes detonating a shaped charge of the perforating module to perforate the casing string, an interior of the perforating module being sealed from a central passage of the outer sleeve at block 506. In some embodiments, block 506 comprises detonating one of the shaped charges 300 of the perforating gun 100 shown in FIG. 3, where an interior of each of the perforating modules 200A-200C is sealed from the central passage 104 of outer sleeve 102.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A perforating gun deployable in a wellbore as part of a tool string, the perforating gun comprising:

an outer sleeve comprised of a generally tubular wall structure having a peripheral surface around the outside, opposite ends thereof and a central passage therethrough extending from one end to the other end and further including a connection at each end to connect to other tools in the tool string wherein the outer sleeve is configured to carry the tensile and compressive forces imposable on the perforating gun as the perforating gun is deployed in the wellbore; and at least one pressure-sealed perforating module installed within the central passage of the outer sleeve having a shaped charge sealed therein and wherein the installation of the pressure-sealed perforating module within the outer sleeve is configured to substantially eliminate the transfer of tensile or compressive forces imposable on or by the tool string onto the at least one pressure-sealed perforating module.

2. The perforating gun according to claim 1, wherein the outer sleeve includes at least one radial perforation through the tubular wall structure from the central passage to the peripheral surface that is sized for an explosive jet from a shaped charge to pass through the tubular wall structure and then penetrate through casing inside the wellbore, and wherein the shaped charge of the at least one pressure-sealed perforating module is oriented in substantial alignment with the radial perforation in the tubular wall structure of the outer sleeve.

3. The perforating gun according to claim 2, wherein the at least one pressure-sealed perforating module comprises a tubular housing in which the shaped charge is received and having a radial indention formed therein and substantially aligned for the shaped charge to produce an explosive jet therethrough.

4. The perforating gun according to claim 1, wherein the shaped charge of the at least one pressure-sealed perforating module extends longitudinally in a direction oriented at a non-zero angle relative to a longitudinal axis of the outer sleeve.

5. The perforating gun according to claim 4, wherein the plurality of pressure-sealed perforating modules are each designed to withstand wellbore pressure and shock waves generated by the detonation of explosives within the wellbore.

6. The perforating gun according to claim 1, further comprising an axis of the perforating gun extending from one end of the outer sleeve to the other end aligned at the center of the central passage, and further wherein the outer sleeve includes a pressure bulkhead at each end of the outer sleeve wherein the bulkheads attach to the tubular wall structure whereby the pressure-sealed module is in compression in the axial direction and the tubular wall structure is in tension.

7. The perforating gun according to claim 6, further including a plurality of separate pressure-sealed perforating modules installed in the central passage of the outer sleeve, wherein each of the plurality of pressure-sealed perforating modules includes an individually addressable electrical switch which allows for the shaped charges in the plurality of pressure-sealed perforating modules to be detonated in a sequential and selectable firing of individual pressure-sealed perforating modules.

8. The perforating gun according to claim 1, wherein the at least one pressure-sealed perforating module includes an individually addressable electrical switch and its own individual radial perforation in the respective outer sleeve substantially aligned for the shaped charge to produce an explosive jet therethrough wherein an individually addressable switch allows for the shaped charge in a pressure-sealed perforating module to be detonated individually in a sequential and selectable firing manner.

9. The perforating gun according to claim 1, wherein the at least one pressure-sealed perforating module comprises a tubular housing having an interior in which the shaped charge is received and which is sealed from the central passage of the outer sleeve.

10. The perforating gun according to claim 9, wherein the at least one pressure-sealed perforating module comprises an individually addressable electrical switch and an electrical connector coupled to the tubular housing and electrically connected to the electrical switch.

11. A tool string comprising a plurality of perforating guns attached to one another end to end where the perforating guns each comprise:

an outer sleeve comprised of a generally tubular wall structure having a peripheral surface around the outside, opposite ends thereof and a central passage therethrough extending from one end to the other and further including a connection at each end to connect to other tools in the tool string wherein the outer sleeve is configured to carry the tensile and compressive forces imposable on the perforating gun as the perforating gun is deployed in a wellbore; and a plurality of separate pressure-sealed perforating modules installed within the central passage of the outer sleeve, each pressure-sealed perforating module having a shaped charge therein and wherein the installation of the pressure-sealed perforating module within the outer sleeve is arranged in a manner that substantially eliminates tensile or compressive forces imposable on or by the tool string to be transmitted to or imposed upon any pressure-sealed perforating module.

12. The tool string according to claim 11, wherein each of the plurality of pressure-sealed perforating modules includes an individually addressable electrical switch which allows for the shaped charges in the plurality of pressure-sealed perforating modules to be detonated in a sequential and selectable firing of individual pressure-sealed perforating modules.

13. The tool string according to claim 11, wherein the installation of the plurality of pressure-sealed perforating modules within the outer sleeve is configured to substantially eliminate the transmission of tensile or compressive forces imposable on or by the tool string upon any of the plurality of pressure-sealed perforating modules.

14. The tool string according to claim 11, wherein the outer sleeve of each perforating gun includes a plurality of radial perforations through the wall from the central passage to the peripheral surface sized for an explosive jet from a shaped charge to pass through the wall and then penetrate through casing inside the wellbore, and wherein the shaped charge of each of the plurality of pressure-sealed perforating modules is oriented in substantial alignment with the radial perforation in the wall of the outer sleeve.

15. The tool string according to claim 11, wherein the shaped charge of each of the plurality of pressure-sealed perforating module extends longitudinally in a direction oriented at a non-zero angle relative to a longitudinal axis of the outer sleeve.

16. The tool string according to claim 11, wherein each perforating gun includes an axis of the perforating gun extending from one end of the outer sleeve to the other end aligned at the center of the central passage, and further wherein the outer sleeve of each perforating gun includes a pressure bulkhead at each end of the outer sleeve wherein the bulkheads attach to the tubular wall structure whereby each of the plurality of pressure-sealed modules are in compression in the axial direction and the tubular wall structure is in tension.

17. The tool string according to claim 11, wherein the plurality of pressure-sealed perforating modules includes at least three pressure-sealed perforating modules installed in the central passage of the outer sleeve where each of the at least three pressure-sealed perforating module includes an individually addressable electrical switch which allows for the shaped charges in the at least three pressure-sealed perforating modules to be detonated in a sequential and selectable firing of individual pressure-sealed perforating modules.

18. The tool string according to claim 11, wherein the plurality of pressure-sealed perforating modules are individually and separately sealed from each other.

19. The tool string according to claim 11, wherein each of the plurality of pressure-sealed perforating modules comprises a tubular housing having an interior in which the shaped charge is received and which is sealed from the central passage of the outer sleeve.

20. The tool string according to claim 11, wherein each of the plurality of pressure-sealed perforating modules comprises an electrical connector to electrically connect each of the plurality of pressure-sealed perforating modules together in response to inserting each of the plurality of pressure-sealed perforating modules into the central passage of the outer sleeve.

* * * * *